US008056184B2

(12) United States Patent
Sempert et al.

(10) Patent No.: US 8,056,184 B2
(45) Date of Patent: Nov. 15, 2011

(54) DOOR LOCK DEVICE

(75) Inventors: Frank Sempert, Remscheid (DE); Juan-Emilio Molina-Alvarez, Remscheid (DE); Katja Kottsieper, Deggendorf (DE)

(73) Assignee: Edscha AG, Remscheid (DE)

( * ) Notice: Subject to any disclaimer, the term of this patent is extended or adjusted under 35 U.S.C. 154(b) by 270 days.

(21) Appl. No.: 11/885,121

(22) PCT Filed: Feb. 25, 2006

(86) PCT No.: PCT/DE2006/000322

§ 371 (c)(1),
(2), (4) Date: Aug. 23, 2007

(87) PCT Pub. No.: WO2006/089528

PCT Pub. Date: Aug. 31, 2006

(65) Prior Publication Data

US 2008/0209675 A1 Sep. 4, 2008

(30) Foreign Application Priority Data

Feb. 25, 2005 (DE) ..... 20 2005 003 287 U

(51) Int. Cl.
*E05C 17/22* (2006.01)

(52) U.S. Cl. ..... 16/86 C; 16/86 B; 292/266; 292/277

(58) Field of Classification Search ..... 16/86 C, 16/81, 51, 63, 65, 86 B, 371, 374; 296/146.11, 296/146.4; 292/262, 265, 266, 275, 277, 292/100, DIG. 15, DIG. 19
See application file for complete search history.

(56) References Cited

U.S. PATENT DOCUMENTS

| | | | | |
|---|---|---|---|---|
| 385,400 | A * | 7/1888 | Bachman | 292/193 |
| 2,237,046 | A * | 4/1941 | Breitenwischer | 16/86 C |
| 4,674,230 | A * | 6/1987 | Takeo et al. | 49/32 |
| 6,349,448 | B1 * | 2/2002 | Breed et al. | 16/82 |
| 6,842,943 | B2 | 1/2005 | Hoffmann et al. | 16/82 |
| 6,901,630 | B2 * | 6/2005 | Liang et al. | 16/82 |
| 7,076,833 | B2 * | 7/2006 | Murayama et al. | 16/82 |
| 7,240,399 | B2 * | 7/2007 | Murayama et al. | 16/82 |
| 7,383,614 | B2 * | 6/2008 | Matsuki | 16/86 B |

(Continued)

FOREIGN PATENT DOCUMENTS

DE 196 32 101 2/1998

(Continued)

*Primary Examiner* — Victor Batson
*Assistant Examiner* — Michael Lee
(74) *Attorney, Agent, or Firm* — Davidson, Davidson & Kappel, LLC

(57) ABSTRACT

The present invention relates to a door lock device for a motor vehicle door, comprising: a door retaining bar mounted on the door or the body to be pivotable, and including one first side and a profiled section formed on the first side; a first braking element arranged respectively on the other part (door or body), which is applied by sections on the first side of the door retaining bar under the effect of a preload, and which, with the profiled section of the first side, defines retaining positions. The inventive door lock device, which enables the door to be selectively opened via defined retaining positions, in particular by a specific stop, is produced according to the present invention such that an actuating device is associated with the first braking element, and so that the actuating device enables the first braking element to be moved against the preload to be no longer in contact with the first side of the door retaining bar.

29 Claims, 2 Drawing Sheets

U.S. PATENT DOCUMENTS

| | | | | |
|---|---|---|---|---|
| 7,469,944 | B2 * | 12/2008 | Kitayama et al. | 292/262 |
| 7,530,141 | B2 * | 5/2009 | Heinrichs et al. | 16/86 C |
| 2001/0013154 | A1 * | 8/2001 | Ng et al. | 16/82 |
| 2003/0037411 | A1 * | 2/2003 | Seo | 16/86 C |
| 2004/0111832 | A1 | 6/2004 | Murayama et al. | 16/82 |
| 2004/0251696 | A1 * | 12/2004 | Murayama et al. | 292/262 |
| 2006/0150367 | A1 * | 7/2006 | Matsuki | 16/86 C |

FOREIGN PATENT DOCUMENTS

| | | | |
|---|---|---|---|
| DE | 100 25 185 | | 11/2001 |
| EP | 216689 | A1 * | 4/1987 |
| EP | 474918 | A1 * | 3/1992 |
| EP | 1033463 | A2 * | 9/2000 |
| JP | 2004-360308 | A | 12/2004 |
| JP | 2006290296 | A * | 10/2006 |

* cited by examiner

DOOR LOCK DEVICE

BACKGROUND

The invention relates to a door lock device.

Door lock devices are known from practice which comprise a pivotably mounted door retaining bar, with a profiled section being provided on at least one side of the door retaining bar, together with which a first braking body, which is mounted under prestress in relation to the door retaining bar, defines a retaining position, the first braking body usually being arranged in a depression of the profiled section of the door retaining bar in one of the retaining positions. A stop, in particular an end stop, can be produced by suitable configuration of the profiled section, for example by the profiled section of the door retaining bar being designed such that it rises steeply such that the first braking body cannot be guided over the steeply rising profiled section without a considerable effort. Difficulties arise in such a manner that, in the case of a door lock device, the door retaining bar of which has a stop formed by a steeply protruding profiled portion, the door cannot be opened as an operator chooses, in particular beyond the position defined by the stop formed.

DE 100 25 185 A1 describes a door lock device for a door of a motor vehicle, which comprises a door retaining bar, on the first side of which a profiled section is formed, the door retaining bar interacting with a first braking body which bears against the first side with the profiled section under a stress caused by a helical spring, the profiled section having depressions which define the retaining positions. It is disadvantageous that it is not possible to bypass individual retaining positions or a stop if the need arises, therefore the stop which, for example, defines a 90° open position of the door, not being bypassed, if an operator chooses, in such a manner that the door can be transferred from the 90° open position into a position with a greater opening angle, for example 180°.

SUMMARY OF THE INVENTION

An object of the present invention is to provide a door lock device in such a manner that optional opening of the door beyond the defined retaining positions, in particular beyond a defined stop, is possible.

In accordance with an embodiment of the present invention, provided is a door lock device, comprising: a door retaining bar which can be mounted pivotably on one of a door and a vehicle body, the door retaining bar having a first side, a profiled section being formed on the first side, a first braking body which is arranged on the other of the door and the vehicle body, the first braking body having at least one surface section bearing against the first side of the door retaining bar under prestress such that the first braking body and the profiled section of the first side define at least one retaining position, wherein the first braking body is assigned an actuating device, and wherein the first braking body can be brought out of contact with the first side of the door retaining bar counter to the prestress by means of the actuating device.

By means of the provision of an actuating device, by means of which an operator can bring the first braking body out of contact with the first side of the door retaining bar counter to the prestress, it is possible to raise the first braking body over the first side of the door retaining bar in such a manner that, upon further movement of the door or the door retaining bar, the first braking body can run over the profiled section, in particular over a steep portion of the profiled section that defines the stop. It is therefore possible to open the door further beyond the opening angle defined by the stop of the door retaining bar, if the need arises.

It may be furthermore advantageous, for example, that the actuating device can be fitted in addition to an already existing housing, which can therefore be retrofitted in a simple manner. The door lock device can be in particular of simple construction and easy to actuate by an operator.

The actuating device according to a further embodiment of the present invention is preferably designed as a lever which comprises a first arm on which a gripping device for the operator is arranged, a second arm of the lever acting on the first braking body. It has proven favorable in this case, for example, that a lever ratio is formed, on the basis of which the first braking body can be brought out of contact with the first side of the door retaining bar counter to the prestress with only a little effort by the operator, for example.

In embodiments of the present invention wherein the actuating device is designed as a lever, it may be favorable in particular to design the second arm of the lever, which engages on the first braking body, as a fork which receives a section of the first braking body between a first fork arm and a second fork arm, and therefore the first braking body may be securely grasped by the second arm of the lever, but at the same time may retains a substantial freedom of movement.

It may be furthermore favorable, for example, to fix the actuating device, like the first braking body, on the vehicle body, as a result of which the actuating device and the first braking body can be produced and can be fitted as a preassembled unit.

In various embodiments of the present invention, a favorable configuration of the first braking body can make provision for the latter to have a flattened, spherical first end which interacts with the first side of the door retaining bar, for the first braking body to comprise a shank part which is engaged around by a spring element, designed, for example, as a helical spring, and for the first braking body to be widened at a second end, with, when the second arm of the lever of the actuating device is formed, the first arm of the fork engaging under the second arm of the fork below the widened second end of the first braking body.

It may be preferably provided, in a preferred embodiment of the present invention, to mount the first braking body such that it is guided in a longitudinally displaceable manner essentially perpendicularly with respect to the first side of the door retaining bar such that, when the actuating device is operated, the first braking body can be removed perpendicularly along the mounting from the first side of the door retaining bar without receiving a further movement component.

Further advantageous features of the invention emerge from the description herein below of a preferred exemplary embodiment of a door lock device according to the present invention, and from the dependent claims.

The present invention will be described and explained in more detail below with reference to a preferred exemplary embodiment of a door lock device according to the present invention and with reference to the attached drawings.

DETAILED DESCRIPTION

Figure 1:
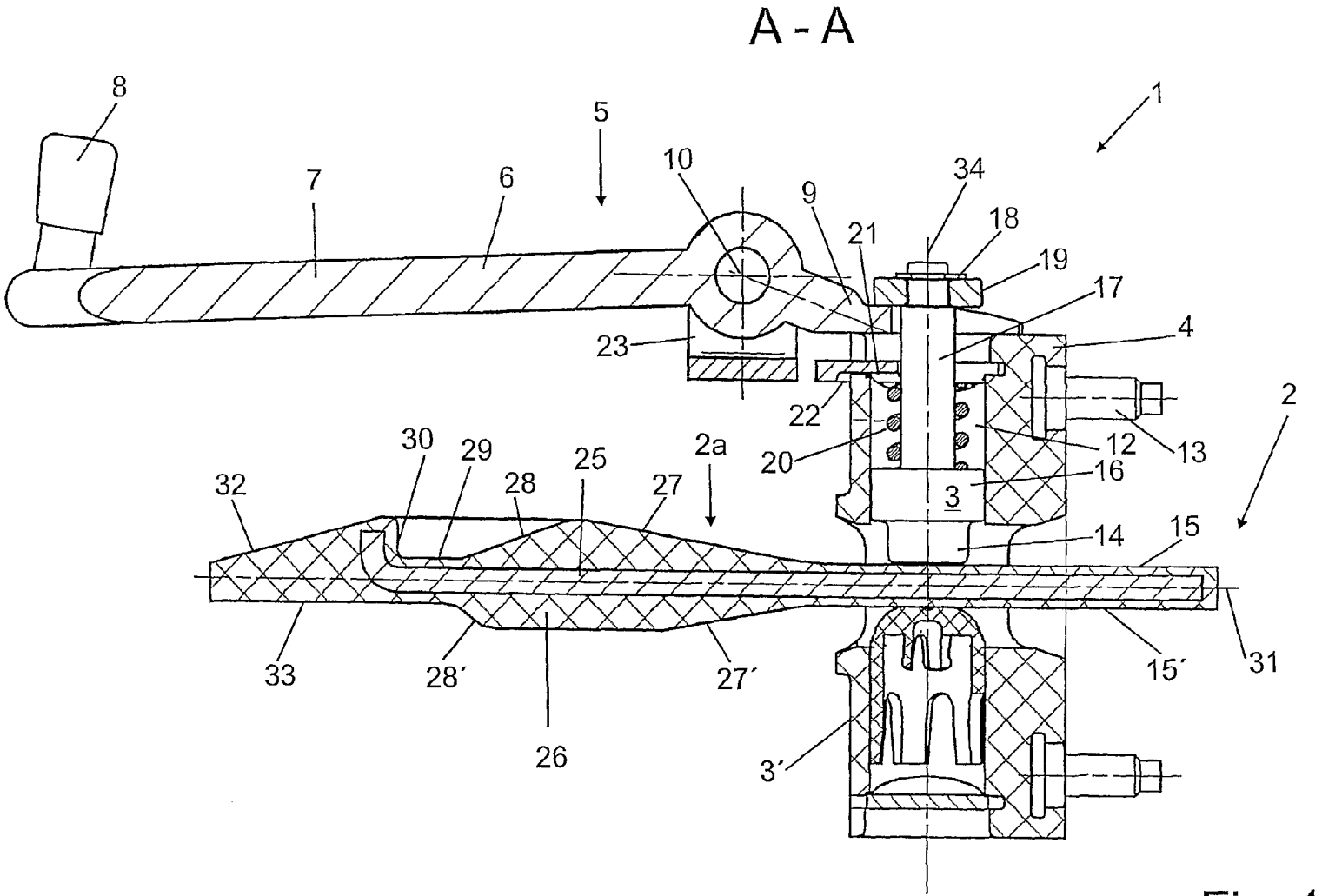
FIG. 1 shows a partially sectioned view of an exemplary embodiment of a door lock device according to an embodiment of the present invention along the section line A-A

FIG. 1 shows a door lock device 1 according to an embodiment of the present invention which comprises a door retaining bar 2 and a first braking body 3, the first braking body 3 being mounted in a housing 4 in an essentially longitudinally displaceable manner. An essentially straight section 2*a* of the door retaining bar 2 is illustrated in FIG. 1.

The first braking body 3 is assigned an actuating device 5 which comprises a lever 6, the lever 6 having a first lever arm 7 with a gripping device 8 at which an operator can grasp and actuate the lever 6. The lever 6 comprises a second arm 9 which is fastened to the first arm 7 and is offset in an imaginary extension of the first arm 7 of the lever 6. The first arm 7 and the second arm 9 of the lever 6 are mounted rotatably about a common rotation point 10, the common rotation point 10 being at a considerably larger distance from the gripping part 8 than from a fork 11—which can readily be seen in particular in FIG. 2, which acts on the first braking body 3.

The housing 4 has an essentially cylindrical hole 12 in which the first braking body 3 is guided. The retaining housing 4 can be fastened to a vehicle body by means of screws 13.

The first braking body 3 comprises a flattened, spherical end 14 with which it bears on a first side 15 of the door retaining bar 2, a guide section 16 which is essentially complementary to the hole 12 of the housing 4, and a shank part 17 which is arranged essentially concentrically with respect to the guide section 16 and the hole 12, the shank part 17 being of widened design at a second end 18 of the first braking body 3, for which purpose a radial projection 19 is provided. The first braking body 3 is assigned a spring element which is designed as a helical spring 20 surrounding the shank part 17. The helical spring 20 makes the first end 14 of the first braking body 3 impinge on the first side 15 of the door retaining bar, for which purpose the helical spring 20 is supported against an abutment plate 21 which passes laterally through the retaining housing 4 at an opening 22, then merges into an upright section 23 which is bent through 90° and at which the common rotation point 10 of the first arm 7 and of the second arm 9 of the lever 6 is fixed on the vehicle body.

The door retaining bar 2 comprises a metal core 25 which, on both sides, has a coating 26 with a thickness which varies along the longitudinal extent of the straight section 2*a* of the door retaining bar 2, thus forming a profiled section. The coating 26 is of widened design in some sections, thus resulting in a rising ramp 27 which merges into a falling ramp 28. The falling ramp 28 is adjoined by a planar profile 29 which is followed by a steeply rising profiled portion 30. In the region of the steeply rising profiled portion 30, the otherwise planar door retaining bar 2, which is designed, in particular, as a sheet-metal blank, is bent upward, in the direction of the rising profiled portion 30.

It should be noted that the contour profile formed by the coating 26 in the region of the steeply rising profiled portion 30 is essentially complementary to the first end 14 of the first braking body 3, such that the first braking body 3, if the latter is located in the planar profile 29, is placed, at least in some sections, with an approximate form fit against the contour of the steeply rising profiled portion 30 and cannot be moved further, in particular by displacement along an axis 31 of the essentially straight section 2*a* of the door retaining bar 2.

The steeply rising profiled portion 30 is adjoined by a falling portion 32, which is no more supported by the metal core 25 of the door retaining bar 2 and is formed exclusively by the coating 26.

The door lock device 1 furthermore comprises a second braking body 3' which interacts with a second side 15' of the door retaining bar 2. The second side 15' comprises a rising ramp 27', a falling ramp 28' and a section 33 running essentially horizontally. It should be noted that the contour of the first side 15 and the contour of the second side 15' of the door retaining bar 2 are not formed symmetrically with respect to the axis 31 of the door retaining bar 2. The first braking body 3 and the second braking body 3' are aligned with each other along a common axis 34.

Figure 2:
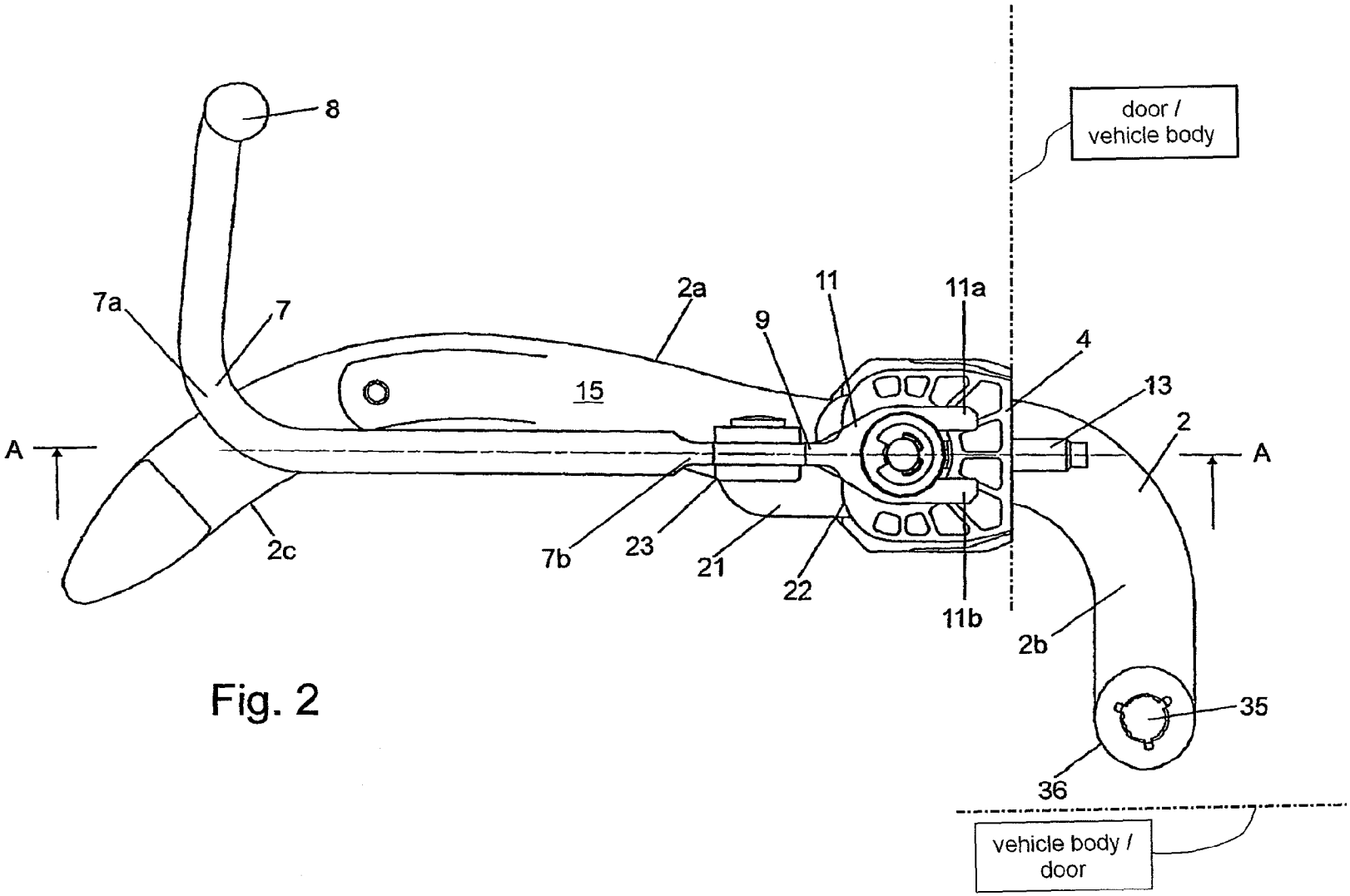
FIG. 2 shows a plan view of the door lock device shown in FIG. 1 with the section line A-A.

FIG. 2 shows that the door retaining bar 2 comprises, in addition to the essentially straight section 2*a* shown in FIG. 1, a first section 2*b*, which is bent through approximately 90° and has a bearing eye 35 at a first end 36, and a second section 2*c*, which is curved in the same direction as the first bent section 2*b* and is bent through approximately 45°. Such a configuration of the door retaining bar 2 is vehicle specific and may not be necessary in the exemplary embodiment of the present invention described herein. It can furthermore be seen that the first arm 7 of the lever 6 comprises a first section 7*a*, which is curved through approximately 90°, and a second section 7*b*, the second section 7*b* of the first arm 7 of the lever 6 being arranged essentially as an extension of the second arm 9. The second arm 9 comprises the fork 11 with the first fork arm 11*a* and the second fork arm 11*b*, with the second end 14, which is widened in relation to the shank part 17, of the first braking body 3 being accommodated between the two fork arms 11*a* and 11*b*. FIG. 2 also shows the abutment plate 21 which emerges from the housing 4 at the opening 22, with the rotation point 10 of the lever 6 being arranged on the upright section 23 of the abutment plate 21.

The exemplary embodiment of the present invention described herein functions as follows:

In the position illustrated in FIG. 1, the helical spring 20 braces the first end 14 of the first braking body 3 against the first side 15 of the door retaining bar 2 in such a manner that a defined friction occurs between the first braking body 3 and the surface of the first side 15 of the door retaining bar. The second braking body 3' is likewise made to impinge on the second side 15' of the door retaining bar 2 by a spring element. If the door moves relative to the vehicle body, the door retaining bar 2 is displaced with respect to the two braking bodies 3, 3', with the latter passing through different portions of the profiled section. The friction is increased along the rising ramp 27, 27', and, in the process, the spring element, specifically the helical spring 20 in the case of the first braking body 3, is tensioned. The spring element, in particular the helical spring 20 of the first braking body 3, is correspondingly relaxed when the braking bodies 3, 3' slide along the falling ramp 28, 28'. If the first braking body 3 bears approximately with a form fit against the steeply rising profiled portion 30, sliding of the first braking body 3 along the first side 15 of the door retaining bar 2 is stopped in particular because of the action by the helical spring 20, and therefore the door retaining bar 2 cannot move further relative to the housing 4 fixed on the vehicle body, and a stop is defined.

If the first braking body 3 is located in the planar profile 29 and bears at least in some sections in an approximately form-fitting manner against the steeply rising profiled portion 30, an operator acts on the handle 8 of the lever 6 and presses down the first arm 7 counterclockwise, as shown in FIG. 1, such that the second arm 9 with the fork 11 rises. Due to the offset of the second arm 9 in relation to the extension of the first arm 7 of the lever 6, the fork 11 executes an approximately linear movement upward. Since the fork 11 grasps the second end 18 of the first braking body 3 by means of the two fork arms 11*a*, 11*b*, the first braking body 3 is raised when the lever 6 is actuated and moves out of contact with the first side 15 of the door retaining bar 2. In the process, the first braking body 3 is raised in relation to the first side 15 of the door retaining bar 2 by an amount such that the first braking body 3 no longer bears approximately in some sections with a form fit against the steeply rising profiled portion 30. In particular, the effect of the steeply rising profiled portion 30 as a stop is therefore cancelled, and therefore the door retaining bar 2 can be moved further in relation to the housing 4, and the door, which, with the stop, is in an approximately 90° open position as in this exemplary embodiment, can be transferred into an approximately 180° open position, with the braking bodies 3, 3' running in the second curved section 2*c* of the door retaining bar 2. If the steeply rising section 30 has moved away under the first braking body 3 raised by the lever 6, the operator can let go of the lever 6, and therefore the first braking body 3 comes into contact again with the first side 15 of the door retaining bar 2. The first braking body 3 runs along the falling section 32 of the first side 15 such that the braking action of the first braking body 3 decreases as opening increases. The contribution of the second braking body 3' in this phase of the opening of the door is low, since the second braking body 3' is located in the horizontal section 33 of the second side 15' of the door retaining bar 2.

If the door is closed starting from the 180° open position, the first braking body 3 runs up the ramp, which rises in a comparatively shallow manner, of the section 32, then drops into the planar profile 29 and slides up the ramp 28 without the steeply rising section 30 turning out to be a stop, and therefore the door can readily be transferred via the 90° open position into the closed position. However, the contribution of the second braking body 3' is to be overcome, the second braking body being in contact with the respectively associated section of the second side 15' in every position of the door retaining bar 2 and—as a function of the profiled section of the second side 15'—making a contribution to the force to be applied for closing the door.

The invention has been described above with reference to an exemplary embodiment in which the actuating device only acts on the first braking body 3. The actuating device can also act on both braking bodies 3, 3'. If the actuating device is designed, in particular, as a lever, for example, the movement of the lever can be transmitted to the second braking body via a joint, and therefore the two braking bodies can be actuated together by the operator actuating the lever a single time.

In the exemplary embodiment described herein above, the second arm 9 of the lever was designed as a fork 11 and the second end 18 of the first braking body 3 was accommodated in a largely freely moveable manner between the fork arms 11*a*, 11*b* of said fork 11. Another manner of fastening the lever to the first braking body 3 can also be provided; in particular, a lever can be coupled directly to the first braking body, for example by means of a ball and socket joint.

It likewise may not be necessary to use braking bodies 3, 3' of the previously described construction. If the braking bodies are designed, for example, as rollers or as balls guided in cages, the actuating device can act directly on the rollers or on the balls, for example by the rollers or balls being mounted rotatably about an axis of rotation, with the actuating device acting on the axis of rotation.

As an alternative embodiment or in addition to the exemplary embodiment described herein, it can be provided that the actuating device acts directly on the spring element. If, in the exemplary embodiment described herein above, the second arm 9 of the lever 6 acts directly on one end of the helical spring 20, then the helical spring 20 is relaxed as soon as the lever 6 is actuated. The action upon the first braking body 3 by the helical spring 20 may be therefore, if appropriate, reduced to an extent such that the first braking body 3 can slide over a stop, in particular if the stop is designed as a profiled portion with flanks which are not too steep to slide over, for example.

As another alternative embodiment or in addition to the exemplary embodiment described herein, it can be provided that the first braking body, which may be raised in relation to the first side by the actuating device, can remain, for which purpose a latching device can be provided on the actuating device and/or on the braking body itself, for example. In particular, the first braking body can engage in a groove or comparable recess, for example. In both cases, the operator may only need to actuate the braking device briefly, and can then let go while the first braking body, for example, only comes into contact again with the first side of the door retaining bar when the door is moved counter to the opening direction and the latching device is released.

What is claimed is:

1. A door lock device, comprising:

a door retaining bar which can be mounted pivotably on one of a motor vehicle door and a motor vehicle body, the door retaining bar having a first side, a profiled section being formed on the first side, a first braking body which is axially displaceable in a guide opening of a housing, wherein the housing is arranged on the other of the door and the vehicle body, wherein the first braking body has at least one surface section bearing against the first side of the door retaining bar under prestress such that the first braking body and the profiled section of the first side define at least one retaining position, wherein the first braking body is assigned an actuating device, wherein the first braking body can be brought out of contact with the first side of the door retaining bar counter to the prestress by the actuating device, and wherein the guide opening is shaped essentially complementary to a guide section of the first braking body.

2. A door lock device, comprising:

a door retaining bar which can be mounted pivotably on one of a motor vehicle door and a motor vehicle body, the door retaining bar having a first side, a profiled section being formed on the first side, a first braking body which is axially displaceable in a guide opening of a housing, wherein the housing is arranged on the other of the door and the vehicle body, wherein the first braking body has at least one surface section bearing against the first side of the door retaining bar under prestress such that the first braking body and the profiled section of the first side define at least one retaining position, wherein the first braking body is assigned an actuating device, wherein the first braking body can be brought out of contact with the first side of the door retaining bar counter to the prestress by the actuating device, wherein the guide opening is shaped essentially complementary to a guide section of the first braking body, and wherein the actuating device comprises a lever having a first arm and a second arm, the first arm of the lever being assigned a gripping device, and the second arm of the lever acting on the first braking body.

3. The door lock device as claimed in claim 2 wherein an end of the second arm of the lever comprises a fork having a first fork arm and a second fork arm, and wherein a portion of the first braking body is arranged between the first fork arm and the second fork arm.

4. The door lock device as claimed in claim 2 wherein the actuating device is fixed on the vehicle body.

5. The door lock device as claimed in claim 2 wherein the first braking body comprises a flattened, spherical first end which interacts with the first side of the door retaining bar.

6. The door lock device as claimed in claim 5, wherein the first braking body comprises a shank part which is of widened design at a second end.

7. The door lock device as claimed in claim 2 wherein the first braking body is mounted such that it can be displaced longitudinally essentially perpendicularly with respect to the first side of the door retaining bar.

8. The door lock device as claimed in claim 2 wherein the first braking body is assigned a spring element to impinge on the first side of the door retaining bar.

9. The door lock device as claimed in claim 8 wherein the spring element is a helical spring.

10. The door lock device as claimed in claim 8 wherein the spring element can be compressed by the actuating device.

11. The door lock device as claimed in claim 2, further comprising a second braking body which interacts with a second side of the door retaining bar.

12. A door arrester defining at least one preferred opening angle of a vehicle door with respect to a vehicle body, comprising:

a door retaining bar pivotably mounted on one of the door and the vehicle body, the door retaining bar comprising a first sliding surface, a profiled section being formed on the first sliding surface;

a first braking body which is axially displaceable within a hole of a housing, wherein the housing is arranged on the other of the door and the vehicle body, wherein the first braking body has at least one surface section tensioning the first sliding surface of the door retaining bar such that the first braking body and the profiled section define a braking force; and an actuating device engaging the first braking body;

wherein the actuating device is able to bring the first braking body out of contact with the first sliding surface of the door retaining bar, and wherein the hole is shaped essentially complementary to a guide section of the first braking body.

13. The door arrester as claimed in claim 12 wherein the first sliding surface comprises at least one stop, and wherein the actuating device includes a position where the first braking body can overcome said at least one stop.

14. The door arrester as claimed in claim 13 wherein the first sliding surface extends also behind the at least one stop.

15. The door arrester as claimed in claim 14 wherein a ramp is provided next to the stop such that in closing direction, the first braking body is displaceable behind the stop without manually operating the actuating device.

16. The door arrester as claimed in claim 14 wherein the portion of the first sliding surface extending behind the at least one stop is of curved design such that an additional opening angle of the door is possible.

17. The door arrester as claimed in claim 12 wherein the door retaining bar is of curved design.

18. The door arrester as claimed in claim 12 wherein the door retaining bar comprises a second sliding surface substantially opposite said first sliding surface, a second braking body being assigned to the second sliding surface.

19. The door arrester as claimed in claim 12 wherein the door retaining bar comprises at least one ramp to define a resistance against a pivoting operation of the door.

20. The door arrester as claimed in claim 12 wherein the actuating device is attached to a portion of the housing.

21. The door arrester as claimed in claim 12 wherein the actuating device is designed as a double-armed lever.

22. The door arrester as claimed in claim 21 wherein a first arm of the double-armed lever engaging an element of the first braking body is shorter than half-length of a second arm of the double-armed lever that is hand-operable.

23. The door arrester as claimed in claim 20 wherein the actuating device is designed as a double-armed lever that is pivotable in an articulation, and wherein the articulation is arranged in a part of the housing.

24. The door arrester as claimed in claim 12 further comprising a spring tensioning the first braking body towards the first sliding surface of the door retaining bar with a spring force, and wherein the actuating device is capable to retract the first braking body against the spring force.

25. The door arrester as claimed in claim 13 wherein the first braking body comprises a protruding engagement member, the engagement member having a flattened proximal end touching the first side of the door retaining bar and a substantially cylindrical circumference for abutting against the stop.

26. A door arrester, comprising:

a door retaining bar which can be mounted pivotably on one of a motor vehicle door and a motor vehicle body, the door retaining bar having a first side, a profiled section being formed on the first side, a first braking body which is arranged on the other of the door and the vehicle body, the first braking body having at least one surface section bearing against the first side of the door retaining bar under prestress such that the first braking body and the profiled section of the first side define at least one retaining position, wherein the first braking body is axially slidably arranged within a housing, wherein the first braking body is raisable by an actuating device comprising a lever having a first arm and a second arm, wherein the first braking body can be brought out of contact with the first side of the door retaining bar counter to the prestress by the actuating device, wherein the first arm of the lever is assigned a gripping device, wherein the second arm of the lever is acting on a portion of the first braking body protruding outside of the housing, and wherein the lever is pivotably connected to the housing.

27. A door lock device, comprising:

a door retaining bar which can be mounted pivotably on one of a motor vehicle door and a motor vehicle body, the door retaining bar having a first side, a profiled section being formed on the first side, a first braking body of substantially cylindrical design which is arranged on the other of the door and the vehicle body, the first braking body having a shank part and at least one surface section bearing against the first side of the door retaining bar, the braking body being axially displaceable under prestress such that the first braking body and the profiled section of the first side define at least one retaining position, wherein the first braking body is assigned an actuating device, wherein the first braking body can be brought out of contact with the first side of the door retaining bar counter to the prestress by the actuating device, wherein the profiled section comprises at least one rising profiled portion for abutment of the first braking body, wherein the actuating device is able to lift the first braking body above at least the one rising profiled portion, and wherein the actuation device comprises a fork which surrounds the shank part of the first braking body and abuts against a radial projection of the first braking body such that the first braking body can be lifted by the actuating device opposite to said prestress.

28. The door lock device according to claim 27, wherein the fork abuts with a fork-side facing away from the first side of the retaining bar against the radial projection of the first braking body.

29. A door lock device, comprising:

a door retaining bar which can be mounted pivotably on one of a motor vehicle door and a motor vehicle body, the door retaining bar having a first side, a profiled section being formed on the first side, a first braking body which is axially displaceable in a guide opening of the housing, wherein the housing is arranged on the other of the door and the vehicle body, wherein the first braking body has at least one surface section bearing against the first side of the door retaining bar under prestress such that the first braking body and the profiled section of the first side define at least one retaining position, wherein the first braking body is assigned an actuating device, wherein the first braking body can be brought out of contact with the first side of the door retaining bar counter to the prestress by means of the actuating device, and wherein the actuating device comprises a lever having a first arm and a second arm, the first arm of the lever being assigned a gripping device, and the second arm of the lever acting on the first braking body.

* * * * *